United States Patent [19]

Reimert

[11] 4,422,507

[45] Dec. 27, 1983

[54] WELLHEAD APPARATUS

[75] Inventor: Larry E. Reimert, Houston, Tex.

[73] Assignee: Dril-Quip, Inc., Houston, Tex.

[21] Appl. No.: 300,001

[22] Filed: Sep. 8, 1981

[51] Int. Cl.[3] ..... E21B 43/01

[52] U.S. Cl. ..... 166/348; 166/75 A; 285/141

[58] Field of Search ..... 285/140, 141, 142, 143, 285/39; 166/75 A, 339, 344, 348, 380, 382

[56] References Cited

U.S. PATENT DOCUMENTS

| | | | |
|---|---|---|---|
| 3,492,026 | 1/1970 | Ahlstone | 166/348 |
| 3,837,684 | 9/1974 | Hynes | 285/142 |
| 3,913,670 | 10/1975 | Ahlstone | 285/142 |
| 4,046,405 | 9/1977 | Bonds | 285/39 |
| 4,053,023 | 10/1977 | Herd et al. | 166/348 |
| 4,167,971 | 9/1979 | Cowan | 285/141 |
| 4,171,018 | 10/1979 | Walker | 166/208 |
| 4,232,889 | 11/1980 | Potch | 285/143 |
| 4,295,665 | 10/1981 | Pierce | 285/141 |
| 4,343,495 | 8/1982 | Nobileau et al. | 285/39 |

*Primary Examiner*—Stephen J. Novosad
*Assistant Examiner*—William P. Neuder
*Attorney, Agent, or Firm*—Vaden, Eickenroht, Thompson, Bednar & Jamison

[57] ABSTRACT

There is disclosed apparatus for use in suspending concentric strings of casing of an offshore well at the ocean floor, wherein at least one hanger for suspending an intermediate casing string is provided with a plurality of vertically spaced, upwardly facing seating surfaces which extend radially inwardly from its bore, and the outer side of such hanger body has a recess thereabout in which a radially expandable ring having a plurality of vertically spaced, downwardly facing landing surfaces is received. As the intermediate hanger body is lowered into the bore of an outer hanger having vertically spaced, upwardly facing seating surfaces extending radially outwardly from its bore, the ring expands radially outwardly to move its landing surfaces into supported positions on the seating surfaces of the outer hanger. As an inner hanger is lowered into the bore of the intermediate hanger, landing surfaces on a radially expandible ring carried within a recess about the outer side of its body are caused to expand with the ring into supported positions on the seating surfaces of the intermediate hanger body. The seating surfaces within the bore of the intermediate hanger body and the recess about its outer side in which the expandible ring is received are on generally the same vertical line.

12 Claims, 8 Drawing Figures

14A
13A
15A
12A
11A
15C
12C
13C
14C
26
26
12B
13B
59
32
26
34
14B
33
30A
15B
23
24
28
30
47
36
37
21
22
20
46
53
27
35
48
31
29
51
25
42
41
37
43
50
36
52
57
45
40
54
38
55
39
11
58
56
12
13
15

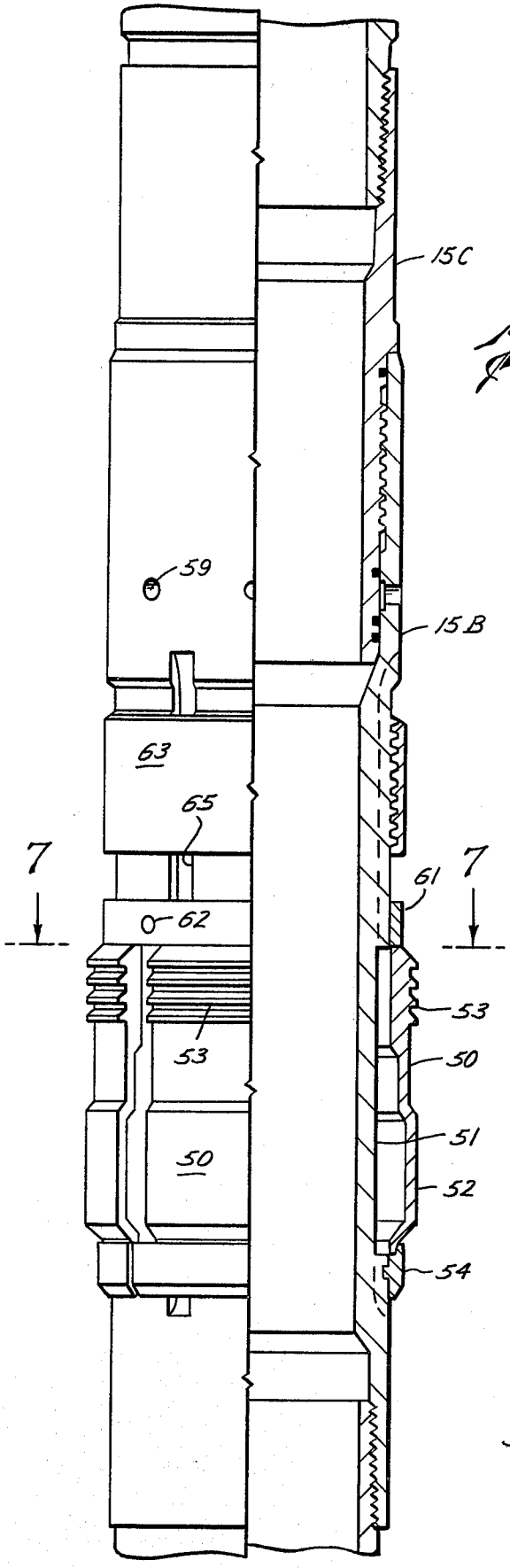
Fig. 6
Fig. 7
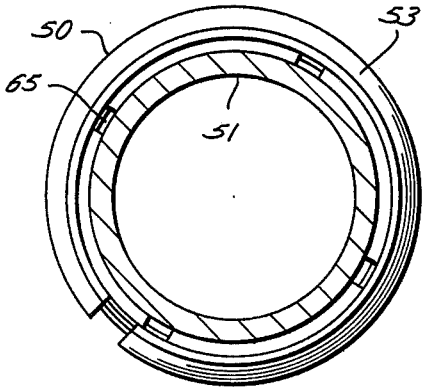
Fig. 8
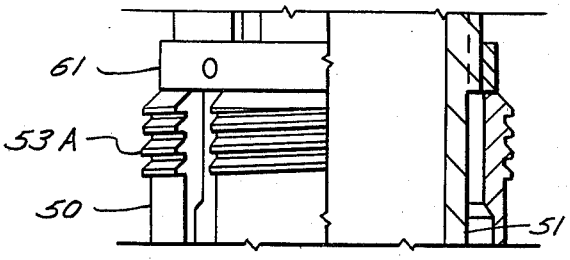

WELLHEAD APPARATUS

This invention relates generally to wellhead apparatus; and, more particularly, to improvements in wellhead apparatus for use in suspending concentric strings of casing of an offshore well at the ocean floor.

In apparatus of this type, commonly referred to as a "mudline" suspension system, each of a plurality of inner casing strings is lowered into a bore drilled in the ocean floor by means of a hanger to which an upward extension of the casing string is connected. When the hanger is landed within a hanger from which the next outer casing string is suspended, cement is circulated down through the extension, hanger, and suspended string, and up into the annulus about the suspended string to anchor it in place. When the well has been tested, the casing extensions may be retrieved, and hangers at the upper ends of the casing strings capped or closed off at the ocean floor, to permit the drilling rig to be moved to another location. When it is desired to complete the well for production purposes, the cap is removed and casing extensions are lowered into connection with at least the innermost suspended casing strings to tie them back to a production platform at the surface of the water.

The annular spaces between an outermost conductor casing and the next inner casing string, and between certain of the successively inner casings, are ordinarily sufficiently large that each string may be suspended from the next outer string by means of a hanger having an outer shoulder adapted to land on a seat on the bore of the hanger from which the next outer casing string is suspended. The shoulder has a bypass therethrough to connect the annular space above and below it for circulation of cement returns, and a running tool connects each hanger to the casing extension.

However, since the annular spaces between the innermost casing strings are much smaller, it has been proposed to provide the hangers from which they are suspended with landing means which is withdrawn or retracted until the string is lowered into the well bore to dispose the landing means opposite the seat on the next outer hanger. In one prior apparatus of this type which is shown and described on pages 2750 and 2751 of the 1980-81 *Composite Catalog,* this landing means comprises a circumferentially split ring which is contractible within a recess in the outer side of the hanger body, as the string is being lowered, and which has a landing surface on its lower end which, when the string has been so lowered, expands outwardly into a supported position on an upward facing seat extending radially inwardly from the bore or the hanger for the next outer casing string.

However, in order to support the weight of the casing string, the expandible rings must have relatively large landing surfaces, which of course require seating surfaces on the next outer hangers of equally large radial extent. As a consequence, in order for the hanger bodies to be thick enough to withstand pressure differences between the casing strings, it has heretofore been thought necessary, in apparatus of this type, to vertically stagger the expandible landing ring and seating surface on at least some of the hangers. This in turn has increased the height of each such hanger and thus the size and cost of the apparatus.

In such prior apparatus, the running tool is connected to its hanger by means of left-hand threads so as to prevent disconnecting joints of the casing extension when the extension is retrieved prior to capping the wellhead. Thus, the running tool may be so disconnected by right-hand torque transmitted thereto by the casing extension whose joints are connected by right-hand threads.

However, care must also be taken to avoid disconnecting the joints of the casing extension as it is connected to its hanger to tie the casing strings back to the production platform. For this purpose, it has been proposed to connect the extension by means of a tie-back tool having right-hand threads for connection with a right-hand thread preparation on the hanger. This need for both right and left-hand thread preparation increases the height and size of the hanger.

It is therefore an object of this invention to provide apparatus of this type above described in which the hangers for the inner strings may be shorter and less expensive than those above described, and more particularly, in which they may be essentially nested one within the other.

Another object is to provide apparauts of this type in which the hangers need not be long enough to provide for two thread preparations to receive the running and tie-back tools, respectively; and, more particularly, to provide hangers having a single thread preparation to which both the running and tie-back tools may be connected.

These and other objects are accomplished, in accordance with the illustrated embodiment of the invention, by apparatus of the type described, which comprises, in combination, an outer hanger which has a plurality of vertically spaced, upwardly facing seating surfaces extending outwardly from its bore, and an intermediate hanger which includes a body having a bore through it and adapted to be lowered into the bore of the outer hanger, the outer side of the intermediate hanger body having a recess about it, and a radially expandible landing ring received within the recess. More particularly, the landing ring has a plurality of vertically spaced, downwardly facing landing surfaces adapted to be moved into supported positions on the seating surfaces of the outer hanger, as the intermediate hanger is lowered into the bore of the outer hanger, and a means is provided for supporting the intermediate hanger body on the landing ring when the ring is so supported from the outer hanger.

More particularly, the intermediate hanger body also has a plurality of vertically spaced, upwardly facing seating surfaces which extend radially outwardly from the bore thereof in position to support landing surfaces on a radially expandible landing ring received within a recess about the body of an inner hanger lowerable into the bore of the intermediate hanger body. Each of the outer hanger, intermediate hanger body, and the inner hanger body is, of course, provided with means from whcih a casing string may be suspended for lowering within a bore drilled into the ocean floor, and to which an upper continuation of the casing string may be connected for extension back to the water surface.

Inasmuch as the weight of the inner casing to be suspended from fthe intermediate hanger is distributed over two or more annular bearing areas of the intermediate casing, each such bearing area may be of proportionately smaller radial extent. Thus, it is possible, in accordance with the present invention, to dispose both the seating surfaces within the bore of the intermediate casing body and the recess thereof in which the landing ring is received on generally the same vertical level and still maintain sufficient hanger body thickness in order to withstand pressure differentials across the casing string suspended from the inner body. Thus, the height of each such hanger and thus the cost of the overall apparatus is minimized.

In accordance with a further novel aspect of the present invention, a tie-back tool which is connectible to its hanger by the same left-hand threads to which the running tool is connectible has torque transmitting parts thereon cooperable with cooperating parts on a torque tool which is connected by left-hand threads to the lower end of a string of left-hand drill pipe for lowering the torque tool into the bore of the tie-back tool. Thus, in order to tie a casing string back to a production platform, the left-hand threads on the lower end of the tie-back tool connected to the lower end of the casing extension are merely lowered onto, or at least only partially made up with the left-hand threads of the hanger, whereby torque may be transmitted through the drill pipe string in order to make up the left-hand theads between the tie-back tool and the casing hanger without transmission of left-hand torque to the casing extension, thereby avoiding any risk of disconnecting the right-hand threads between the adjacent joints of the casing extension.

In the drawings, wherein like reference characters are used throughout to designate like parts:

FIG. 1 is a diagrammatic illustration of an offshore well having a plurality of concentric strings of casing suspended at the mudline within successively smaller diameter bores drilled in the ocean floor, and upper continuations of the casing strings extending from the ocean floor to pressure control apparatus on a drilling rig platform at the water surface level, the outer most conductor casing being broken away in part to show a hanger for a string of casing suspended therefrom, and the casing extensions also being broken away just above the water surface;

FIG. 6 is a side view of the hanger and running tool for the innermost production casing string removed from landed position to permit the landing ring thereof to fully expand, the right-hand side thereof being shown in section;

FIG. 7 is a cross-sectional view of the hanger of FIG. 6 as seen along broken lines 7—7 thereof; and FIG. 8 is a side view of a portion of a modified, version of the hanger shown in FIG. 6.

Figure 1:
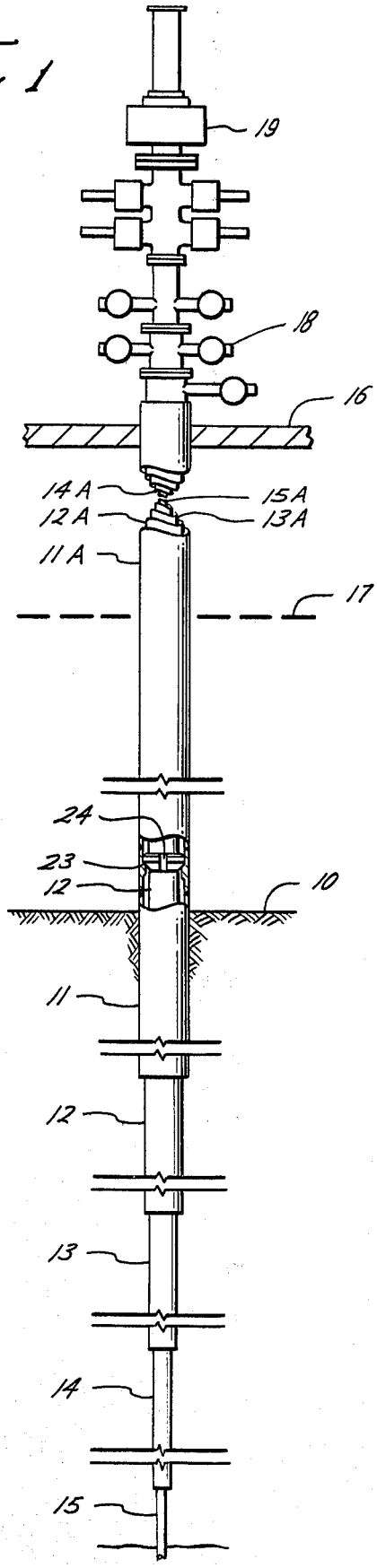

The concentric strings of FIG. 1 include an outermost conductor casing 11 and successively smaller casing strings 12, 13, 14 and 15 suspended within successively smaller diameter bores drilled into the ocean floor 10, the innermost string 15 being known as the production string. As also shown in FIG. 1, upper continuations 11A, 12A, 13A, 14A and 15A of the casing strings extend upwardly to connection with pressure control equipment mounted on a rig or platform 16 at the water surface 17. As well known in the art, this control equipment includes a wellhead 18 having casing heads to which the upper ends of the casing extensions are connected, and a blowout preventer stack 19 installed above the wellhead. As also well known in the art, the lower ends of the suspended casing strings are anchored within well bores by means of columns of cement which, as will be explained to follow, may extend upwardly into the annular space between the casing strings.

As each successively smaller diameter well bore is drilled, the casing string which is to line that bore is lowered into place by means of the hanger from which it is suspended and the casing extension on which the hanger is lowered. During drilling of the portion of the bore hole to receive the casing string 12, mud returns flow upwardly between the drill string and the conductor casing string 11 and its extension 11A. Then, as successive casing strings are lowered into place and suspended at the mudline, each serves as a means for returning drilling mud to the pressure control apparatus on the drilling rig during drilling of the next smaller well bore. As will also be apparent from the description to follow, each of the hangers has flow passages through it which connect the annular space above and below the hanger, so that, when the hanger is landed at the mudline, cement returns may pass upwardly therethrough as the casing string is anchored in place. These and other practices are well known in the art, and therefore form no part of the present invention and consequently require no more detailed description.

Figure 2:
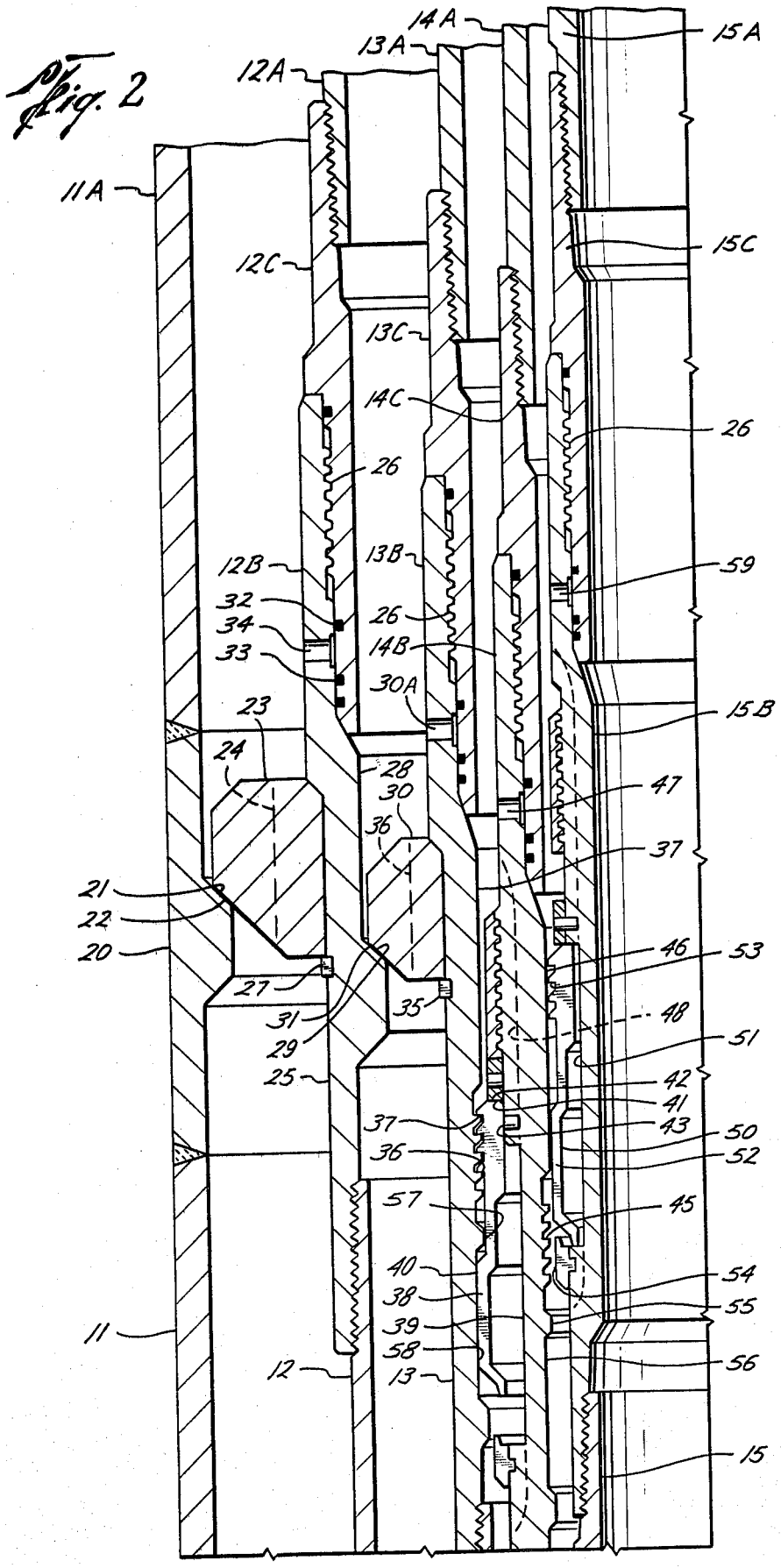
FIG. 2 is a vertical sectional view of one-half of the underwater wellhead apparatus of the present invention, with the hanger for suspending the innermost or production casing string being shown during lowering into a landed position within the hanger from which the next outer casing string is suspended.
Figure 3:
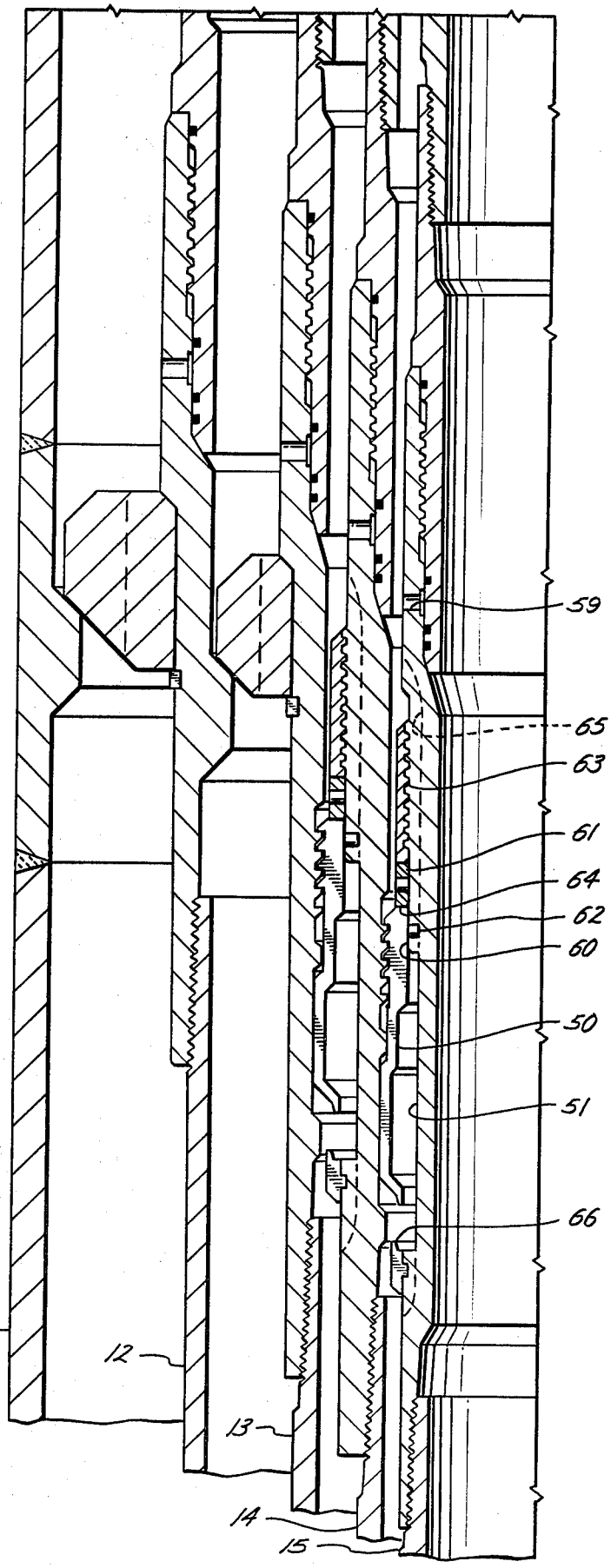
FIG. 3 is a view similar to FIG. 2, but wherein the hanger for the innermost or production string of casing has been lowered into landed position onto the hanger for the next outer string of casing.
Figure 4:
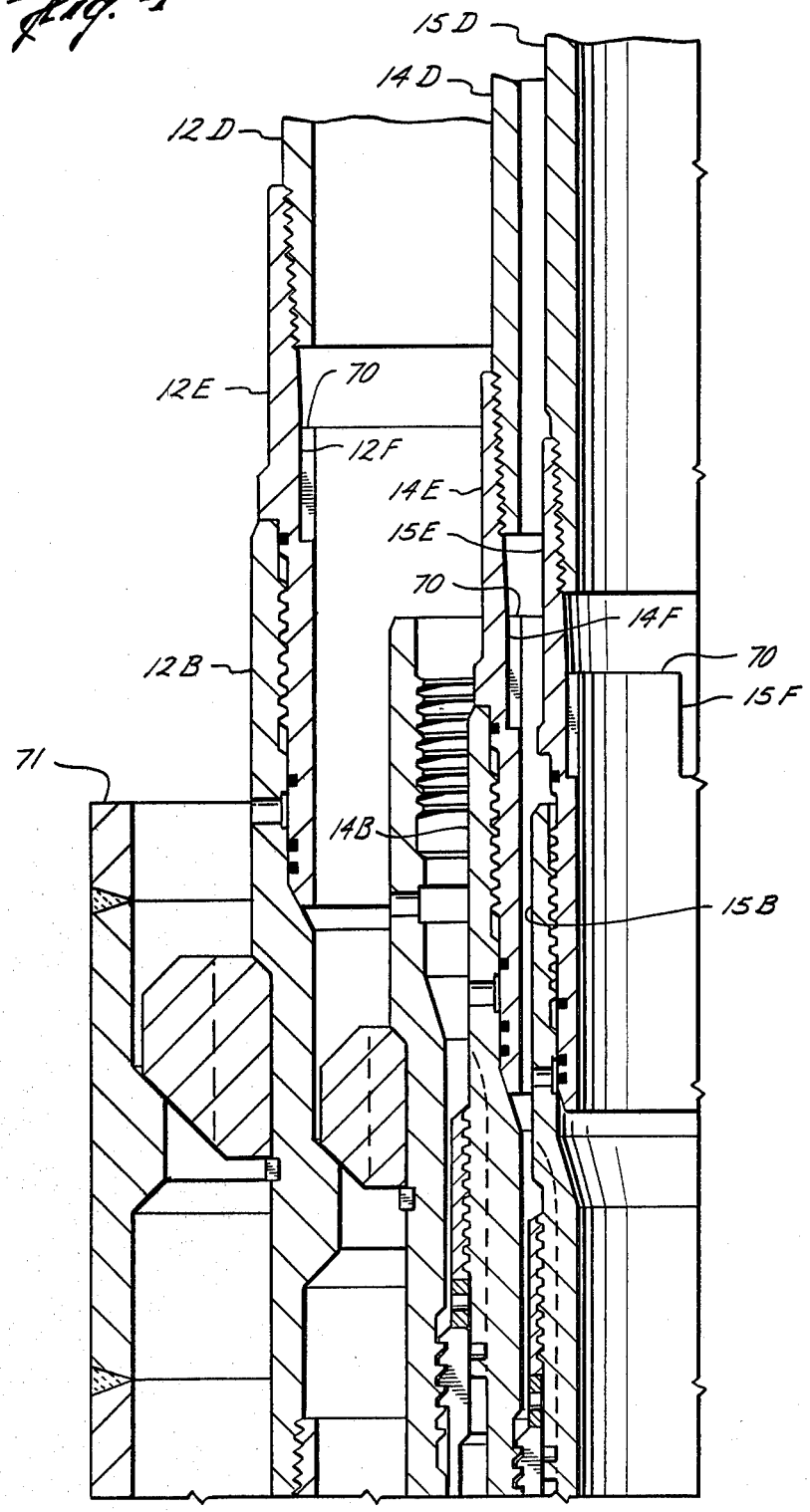
FIG. 4 is another view similar to FIGS. 2 and 3, but following severing and removal of the conductor casing string at the mudline, disconnection and removal of the casing extension from the hangers which suspend the casing strings, and lowering of casing extensions for connection by means of tie-back tools on their lower ends with certain of the hangers.

As shown in FIGS. 2 to 4, the apparatus of the present invention includes a short tubular hanger 20 welded intermediate the conductor casing string 11 and its extension 11A. The inner diameter of section 20 is radially reduced to provide an upwardly facing, tapered seat 21 on which a similarly tapered downwardly facing land 22 on a collar 23 about the body 25 of hanger 12B may be supported in order to suspend casing string 12 within conductor casing 11. As shown, the collar on which shoulder 22 is provided has one or more flow passages 24 to connect the annular space above and below it.

The body 25 of hanger 12B has threads on its lower end for connection with the upper end of casing string 12 and threads 26 on its upper end for connection with a running tool 12C suspended from the lower end of casing extension 12A. The landing collar 23 is locked in place about an intermediate portion of the outer side of hanger 12B by means of a snap ring 27. As will be fully described to follow, the hanger body 25 has a bore 28 which is radially reduced to provide an upwardly facing, tapered seat 29 on which a downwardly facing shoulder 31 of landing collar 30 carried about the body of hanger 13B may be supported to suspend the weight of the next inner casing string 13.

As previously described, the threads 26 which connect the running tool 12C with the hanger body 25 are left-hand. As shown, they are formed on a downwardly extending male part of the running tools which carries O-rings 32 and 33 for sealing within an inner cylindrical surface of the hanger body beneath the threads 26 and above and below a port 34 in the body. As well known in the art, the threads 26 of the running tool may be backed off to raise the O-rings 33 above the port 34 and thus permit cement within the annulus to be washed out above the hanger, following which the threads may be fully made up to provide a sealed joint between the hanger and running tool.

The landing ring 30 is supported about the body of hanger 13B by means of a locking ring 35, as in the case of the landing ring 23. Also, it has flow passages 30A therein to connect the annulus between the hangers 12B and 13B above and below the landing ring. Furthermore, the running tool 13C is in all material respects similar to the running tool 12C in that it has left-hand threads for connection with left-hand threads 26 of the hanger body to permit the tool to raised and lowered, as desired, so as to open and close the port 36A in the hanger body.

The hanger 13B differs from hanger 12B, however, in that it is specially prepared to suspend hanger 14B from which the next inner casing string 14 is suspended by apparatus constructed and arranged in accordance with the present invention. Thus, as previously described, the next inner casing string 14 and the casing extension 14A are of such diameter that the annular space between them and the casing string 13 and casing extension 13A is relatively small. For this purpose, and in accordance with the present invention, a plurality of vertically spaced, upwardly facing annular seating surfaces 36 are formed on the body of hanger 13B to extend radially outwardly from the bore thereof, and thus in position to support vertically spaced, downwardly facing landing surfaces 37 formed on the outer side of a circumferentially split, radially expandible, landing ring 38 carried within a recess about the outer side of the body of hanger 14B. As will be more fuly understood from the description to follow of the hanger 15B connected to the casing string 15 and casing extension 15A, and its support from the hanger 14B, when landing ring 38 received within an annular recess 39 about the outer side of the body of hanger 14B, the outer diameters of landing surfaces 37 on ring 38 are retracted to a position which permits them to move downwardly through the casing extention 13A and the bore of the casing hanger 13B until such time that they are opposite the seating surfaces 36 on the body of hanger 13B. The ring is so formed that as it has a natural tendency to expand radially outwardly from its position within the recess, so that when so disposed, the ring will expand outwardly to move its landing surfaces into supported position on the seating surfaces and thereby suspend the hanger 14B from the hanger 13B.

As will be more fully understood from the description of hanger 15B, the ring 38 includes a lower annular extension 40 which is cooperable with means in the bore of hanger 13B to hold the ring in retracted position, as it is lowered within the bore of the body of hanger 13B, and thus maintains the landing surfaces above it out of supported positions on seating surfaces 36 until such time that all of the landing surfaces are generally laterally opposite an equal number of seating surfaces 36 on hanger 13B. At this time, the means within the hanger body 13B frees the extension 40 to expand radially outwardly into a recess in the bore of the hanger body and thus permit the landing surfaces above it to move outwardly from the ring into supported positions on the seating surfaces 36.

As will be further understood from the description to follow of hanger 15B, a downwardly facing shoulder 41 about the outer side of the body of hanger 14B above recess 39 seats upon the upper end of the landing ring 38, when the landing ring is expanded to move its landing surfaces into supported positions on the seating surfaces of the hanger 13B, so as to suspend the hanger body from the supported landing ring 38. More particularly, shoulder 41 is formed on a ring or collar releasably connected to the hanger body by a pin which is sheared as the weight of the hanger body is slacked off. This permits its inner annular surface 43 to slide downwardly within the inner diameter of the upper end of landing ring 38, so as to lock the landing ring in its supported position, and a downwardly facing shoulder on the lower end of a nut about the hanger body to move downwardly onto supported position on the upper end of the ring.

Similarly to the hanger 13B, the hanger 14B is provided with vertically spaced, upwardly facing seating surfaces 45 which extend radially inwardly from the bore 46 of its body, and which, as will be described to follow, are adapted to support seating surfaces on the hanger 15B to suspend the hanger and casing string 15 therefrom. As shown, although the annular space between the hangers 13B and 14B is also relatively small, these seating surfaces 45 need not be staggered with respect to the recess 39 of hanger 14B, but instead are at generally the same vertical level. Nevertheless, due to the novel construction and arrangement of these surfaces, the body of hanger 14B is of sufficient thickness to withstand pressure differentials.

The running tool 14C is also of the same construction and connected to the upper end of the body of hanger 14B by means of left-hand threads 26, and thus cooperable therewith in the same manner as the running tools 12C and 13C are cooperable with their hangers 12B and 13B, respectively. Still further, a port 47 is formed in the body of the hanger 14B to permit cement to be washed out of the annular space between the hangers 13B and 14B, upon raising of the running tool 14C, following which the running tool may be lowered into its fully made up, sealed position covering the port 47, as shown in FIG. 3. Also, the body of hanger 14B is provided with flow passages 48 which bypass the abovedescribed nut to connect the annular space above and below the shoulder 41.

As in the case of the hanger 14B, hanger 15B includes a body connected at its lower end to the lower casing string 15 and at its upper end to a running tool 15C on the lower end of casing extension 15A, and a landing ring 50 adapted to be received within a recess 51 about the body of the hanger. As in the case of the ring 38, the ring 50 is circumferentially split so that it may be forced into the radially retracted position of FIG. 2 as it moves downwardly through the casing string 14A and into the bore 46 of hanger 14B. As shown in FIG. 2, vertically spaced, downwardly facing landing surfaces 53 formed about the upper end of the landing ring have outer diameters which are slightly smaller than the outer diameter of a lower annular extension 52 of the landing ring. The landing ring is of generally the same vertical extent as the recess 51, and, when the hanger is removed from the bore hanger 14B, as shown in FIG. 6, the ring is held in a concentric position with respect to the body of the hanger 15B by means of a lower retainer ring 54 having an upwardly extending lip which engages the lower end of the extension 52.

As shown in FIG. 6, the downwardly facing landing surfaces 53, and then the seating surfaces 45 of hanger 14B on which they are to be supported, comprise discrete grooves formed in the split ring 50. Preferably, however, these landing and seating surfaces comprise low pitched threads, as illustrated by the landing surfaces 53A on the alternative hanger shown in part in FIG. 8.

As previously described, a means is provided on each of the hangers 13B and 14B for holding each of the landing rings 40 and 50, respectively, in a radially contracted position within its recess until the landing surfaces on such ring are generally opposite the seating surfaces on the outer sides of the hangers 13B and 14B. In the case of hanger 13B, this comprises a section 57 of the bore of the hanger body beneath seating surfaces 45. In each case, however, the annular extension of the landing ring beneath its landing surfaces are adapted to move within a shallow recess beneath the abovementioned section of the bore as such seating surfaces move downwardly into position for radial expansion outwardly into supported position on the seating surfaces of the next outer hanger. Thus, as shown in the drawings, annular extension 40 of the landing ring 38 is adapted to be received within a recess 58, and annular extension 52 of the landing ring 50 is adapted to move outwardly into the recess 56.

As also described in connection with the seating of the body of hanger 14B upon the supported landing ring 38, following radial expansion of the landing ring of hanger 15B into supported position on the seating surfaces 45 of the hanger 14B, the weight of the body of hanger 15B is slacked off so as to suspend it from the supported landing ring 50 thereof. Thus, as in the case of hanger 14B, the inner diameter of the upper end of landing ring 50 is vertically aligned with the inner diameter of a ring or collar 61 releasably connected to the hanger body at the upper end of recess 51 by means of shear pins 62. Thus, when the weight of the hanger and the casing string suspended therefrom is slacked off, pins 62 are sheared to permit the annular surface 60 of the hanger body to move within the upper end of the expanded landing ring 50 so as to hold it in supported position, and the ring or collar 61 to move upwardly into engagement with the lower end of nut 63 about the hanger body so as to support the downwardly facing shoulder 64 on the lower end of the ring 61 on the upper end of the supported landing ring 50. Flow passages 65 are formed in the body of the hanger 15B to bypass nut 63 and connect the annular spaces above and below shoulder 64. The landing ring is adapted to be retained in a concentric position with respect to the body of the hanger 15B, when removed from within the hanger 14B, by means of a retainer ring 66 of the same construction and having the same function as retainer ring 54.

The running tool 15C connected to left-hand threads 26 on the upper end of the body of hanger 15B is similar in construction and operation to the previously described running tools 12C, 13C, and 14C. Hence, it may be backed off from its fully made up position of FIGS. 2 and 3 to open ports 59 in the hanger body, whereby cement may be washed from the annular space thereabout, and then lowered back into the fully made up sealed position to close the port.

As previously described, upon drilling and testing of the well, it is ordinarily desired to move the drilling rig to which the upper ends of casing extensions 11A–15A are connected to another location. At this time, the extension 11A for conductor casing 11 may be severed and retrieved from a point near the mudline, as shown, for example, at 70 in FIG. 4, and the running tools 13C, 14C and 15C may be backed off from the upper ends of their respective hangers to retrieve the casing extensions 12A–15A to which they are connected. For this latter purpose, right-hand torques is transmitted to the running tools through the casing extensions to back off the left-hand threads 26. Then, the wellhead may be capped by a means not shown, but conventional in the art.

When it is desired to complete the well, the cap is removed, and at least certain of the casing strings are tied back to a permanent platform at the water surface. Ordinarily, one or more of the intermediate strings, such as the casing string 13, is not tied back, but in any event, and as shown in FIG. 4, at least one or more of the inner casing strings, such as casing strings 14 and 15, as well as one of the outer casing strings, such as the casing string 12, are tied back to the platform at the surface of the water by means of casing extensions 12D, 14D and 15D. For this purpose, tie-back tools 12E, 14E and 15E are connected to the right-hand threads of the lower ends of the casing extensions 12D, 14D and 15D, respectively, and then lowered by the extensions into engagement with the left-hand threads 26 on the upper ends of the hangers 12B, 14B and 15B.

Each of the tie-back tools is substantially identical to its counterpart running tool, not only in that it has left-hand threads about a lower portion thereof for connection with threads 26 of its hanger, but also in that it has right-hand threads about its upper end for connection to the lower end of the casing extension. It differs, however, in that it has a slot in its bore adapted to receive a key carried by another tool adapted to be lowered through the casing extension and into the bore of the running tool by means of left-hand drill pipe. Hence, as previously described, it is possible to fully make up the threads 26 between the tie-back tool and its hanger without tramsitting left-hand torque through the casing extension, and thus without danger of disconnecting joints of the extension.

Thus, as shown in FIG. 4, slots 12F are formed in the bore of tie-back tool 12E, slots 14F are formed in the bore of tie-back tool 14E, and slots 15F are formed in the bore of tie-back tool 15E. More particularly, each slot has an open upper end which connects with an upwardly facing, circumferentially interrupted landing shoulder 70 within the tool.

Figure 5:
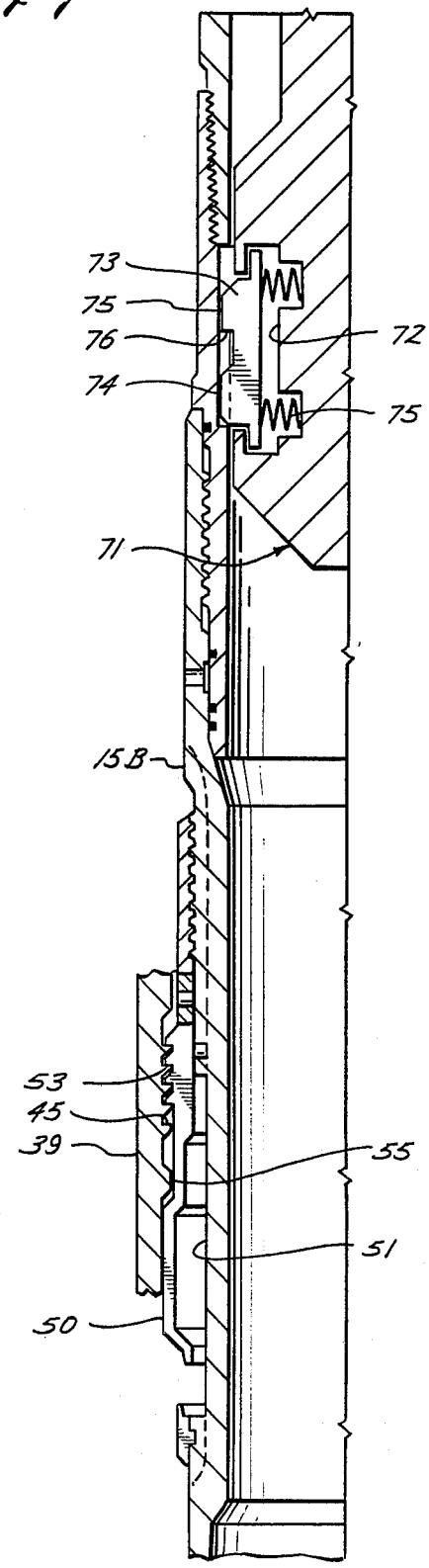
FIG. 5 is a vertical sectional view of one-half of the hanger for the innermost production casing string, landed upon the hanger for the next outermost string of casing, and tied back to the water surface by a casing extension, as shown in FIG. 4, but with a torque tool lowered into the bore of the tie-back tool therefor to fully make up the tie-back tool with its hanger.

As shown in FIG. 5, torque tool 71 comprises a body adapted to be connected to the lower end of the left-hand string of drill pipe (not shown) and to fit relatively closesly within the bore of each casing extension and the tie-back tool connected to its lower end. The torque tool is provided with a series of recesses 72 about the circumference of its body to receive keys 73 which are adapted to move within the recess between the inner, contracted position which permits them to slide downwardly through the casing extension and into the upper end of the tie-back tool, and an outer, expanded position, as shown in FIG. 5, in which a torque-transmitting part 74 thereon is engaged within the slot 15F of tie-back tool 15E, and thus in a position to transmit torque to the tie-back tool for fully making its threads with threads 26 of hanger 15B. As shown in FIG. 5, each key 73 is yieldably urged to its expanded position by means of coil spring 75, so that, with the keys lowered to the level shown in FIG. 5, parts 74 snap into the grooves 15F.

As also shown in FIG. 5, the portion of the keys 73 which protrude from the outer diameter of the torque tool body are somewhat shorter in length than the distance between the lower end of the casing extension and the lower ends of the slots. Also, each key has an outwardly protruding upper end 75 having a shoulder 76 on its lower side to engage with land 70 as the dog moves downwardly into the position of FIG. 5. This engagement of the shoulder with the land prevents further downward movement of the dogs, and thus the torque-transmitting parts 74, out of the slots. The upper ends of the protruding portions 75 are tapered to permit retrieval of the torque tool after making up of the threads 26.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for use in suspending concentric strings of casing of an offshore well at the ocean floor, comprising an outer hanger having a bore therethrough and adapted to be landed at the ocean floor, said outer hanger having at least three vertically spaced, upwardly facing seating surfaces which are parallel to one another and extend radially outwardly from the bore thereof, an inner hanger including a body having a bore therethrough and adapted to be lowered into the bore of the outer hanger, the outer side of the inner hanger body having a recess thereabout, and a ring received within the recess and having a plurality of vertically spaced, downwardly facing landing surfaces which are parallel to one another and the seating surfaces of the outer hanger, said ring being radially expandible, as the inner hanger body is lowered into the bore of the outer hanger to cause the landing surfaces thereof to move into supported positions on the seating surfaces of the outer hanger, means for supporting the inner hanger body on the ring when the ring is so supported from the outer hanger, and means on each of the outer and inner hanger bodies from which a casing string may be suspended for lowering within a bore drilled into the ocean floor to which an upper continuation of the casing string may be connected for extension back to water surface.

2. Apparatus of the character described in claim 1, wherein the seating and landing surfaces comprise threads.

3. Apparatus of the character described in claim 1, wherein the seating and landing surfaces comprised discrete grooves.

4. Apparatus of the character described in claim 1, wherein said inner hanger body also has at least three vertically spaced, upwardly facing seating surfaces which are parallel to one another and extend radially outwardly from the bore thereof at generally the same vertical level as the recess in the outer side thereof.

5. Apparatus of the character defined in claim 4, including another inner hanger including a body having a bore therethrough and adapted to be lowered into the bore of the first-mentioned inner hanger body, the outer side of the other inner hanger body having a recess thereabout, and a ring received within the recess and having at least three vertically spaced, downwardly facing landing surfaces which are parallel to one another and the seating surfaces of the first-mentioned inner hanger body, said last-mentioned ring being expandible, as said other inner hanger body is lowered into the bore of the first-mentioned inner hanger body, to cause the landing surfaces thereof to move into supported positions on the seating surfaces of the first-mentioned inner hanger body, means for supporting said other inner hanger body on the ring of the other inner hanger when said ring is so supported from the first-mentioned inner hanger body, and means on said other inner hanger body from which a casing string may be suspended for lowering within another bore drilled into the ocean floor and to which an upper continuation of said casing string may be connected for extension back to the water surface.

6. A hanger for use in suspending an inner casing within an outer casing string of an offshore well, said hanger comprising a body having a bore therethrough and adapted to be landed at the ocean floor, the outer side of the hanger body having a recess thereabout, and a ring received within the recess and having at least three vertically spaced, downwardly facing landing surfaces which are parallel to one another, said ring being circumferentially split to permit it to radially expand from an inner position, in which its landing surfaces are free to move downwardly within an upward extension of the outer casing string and into the bore of an outer hanger body to which the extension is connected, into an outer position in which they may move out of the recess and into supported positions upon at least three seating surfaces within the bore of said outer hanger body which are parallel to one another and the landing surface on the ring, means for supporting the hanger body on the ring when the ring is expanded to its outer position, and means on the hanger body from which the inner casing string may be suspended for lowering within the outer casing string and into a bore drilled into the ocean floor and to which an upper continuation of the casing string may be connected for extension back to the water surface.

7. A hanger of the character described in claim 6, wherein the seating and landing surfaces comprise threads.

8. A hanger of the character described in claim 6, wherein the seating and landing surfaces comprised discrete grooves.

9. A hanger for use in suspending an inner casing string within an outer casing string of an offshore well, said hanger comprising, an outer body having a bore therethrough and adapted to be landed at the ocean floor, said outer body having at least three vertically spaced, upwardly facing seating surfaces which are parallel to one another and extend radially outwardly from the bore thereof, whereby, upon lowering of an inner hanger body from which the inner casing string is suspended into the bore of the outer body, at least three landing surfaces about the outer side of said inner hanger body which are parallel to one another and the seating surfaces on the outer hanger body may be lowered into supported positions on the seating surfaces of said outer hanger body, and means on said outer hanger body from which the outer casing string may be suspended and to which a upper continuation of the outer casing string may be connected for extension back to the water surface.

10. A hanger of the character described in claim 9, wherein the seating surfaces on the hanger body comprise threads.

11. A hanger of the character described in claim 9, wherein the seating surfaces on the hanger body comprise discrete grooves.

12. A hanger of the character defined in claim 9, wherein the outer side of the outer hanger body has a recess thereabout, and a ring is received in the recess, said ring being circumferentially split to permit it to radially expand from an inner position, in which at least three landing surfaces on said ring which are parallel to one another are free to move downwardly within an upward extension of the next outer casing string and into the bore of the next outer hanger body, into an outer position in which they may move out of the recess and into supported positions upon at least three seating surfaces with the bore of said next outer hanger body which are parallel to the landing surfaces on said ring, means for supporting the hanger body on the ring when the ring is expanded to its outer position, and means on the hanger body from which the inner casing string may be suspended for lowering within a bore drilled into the ocean floor and to which an upper continuation of the casing string may be connected for extension back to the water surface.

* * * * *